US011408686B2

(12) United States Patent
Akagi

(10) Patent No.: US 11,408,686 B2
(45) Date of Patent: Aug. 9, 2022

(54) HEAT EXCHANGER

(71) Applicant: Rinnai Corporation, Aichi (JP)

(72) Inventor: Kazuyuki Akagi, Aichi (JP)

(73) Assignee: Rinnai Corporation, Aichi (JP)

( * ) Notice: Subject to any disclaimer, the term of this patent is extended or adjusted under 35 U.S.C. 154(b) by 25 days.

(21) Appl. No.: 17/020,873

(22) Filed: Sep. 15, 2020

(65) Prior Publication Data

US 2021/0108865 A1 Apr. 15, 2021

(30) Foreign Application Priority Data

Oct. 11, 2019 (JP) ..... JP2019-187630

(51) Int. Cl.

| | |
|---|---|
| ***F28F 3/06*** | (2006.01) |
| ***F24H 9/1809*** | (2022.01) |
| ***F28F 1/32*** | (2006.01) |
| ***F28D 1/047*** | (2006.01) |

(52) U.S. Cl.

CPC ..... *F28F 3/06* (2013.01); *F24H 9/1809* (2013.01); *F28D 1/0477* (2013.01); *F28F 1/325* (2013.01); *F28F 2215/08* (2013.01); *F28F 2265/26* (2013.01)

(58) Field of Classification Search

CPC ..... F24H 9/1809; F28D 1/0477; F28D 2021/0024; F28F 1/32; F28F 1/325; F28F 3/06; F28F 2215/08; F28F 2265/26

See application file for complete search history.

(56) References Cited

U.S. PATENT DOCUMENTS

| | | | | |
|---|---|---|---|---|
| 2014/0190425 | A1* | 7/2014 | Oohigashi | F28F 1/325 122/18.4 |
| 2016/0273850 | A1* | 9/2016 | Okamoto | F28F 1/32 |
| 2017/0205113 | A1* | 7/2017 | Oohigashi | F28F 1/325 |
| 2018/0306529 | A1* | 10/2018 | Kasamatsu | F28F 1/325 |
| 2020/0033071 | A1* | 1/2020 | Kondo | F28F 1/325 |
| 2020/0208923 | A1* | 7/2020 | Wada | F28F 1/325 |
| 2021/0270542 | A1* | 9/2021 | Schlieper | F28F 1/325 |

FOREIGN PATENT DOCUMENTS

JP H11-108456 A 4/1999

* cited by examiner

*Primary Examiner* — Eric S Ruppert
*Assistant Examiner* — Hans R Weiland
(74) *Attorney, Agent, or Firm* — Nakanishi IP Associates, LLC

(57) ABSTRACT

A heat exchanger prevents cracking in heat transfer plates while avoiding lowering heat-exchange efficiency. Heat transfer plates are arranged with a space between them, and a hollow pipe extends through the plates. A high-temperature gas flows through the space to exchange heat with a liquid in the hollow pipe. The heat transfer plates are elongated in the direction in which parts of the hollow pipe are aligned and can thus have thermal expansion accumulating in the elongation direction. The heat transfer plates each include a thermal expansion absorber between an edge of the heat transfer plate receiving inflow of the high-temperature gas and an inter-pipe portion between adjacent parts of the hollow pipe to absorb thermal expansion of the heat transfer plate. A selected one or more of the inter-pipe portions, rather than all, include the thermal expansion absorber.

6 Claims, 8 Drawing Sheets

HEAT EXCHANGER

BACKGROUND OF INVENTION

Field of the Invention

The present invention relates to a heat exchanger that causes heat exchange between a high-temperature gas and a liquid having a lower temperature than the high-temperature gas to heat the liquid.

Background Art

Heat exchangers that cause heat exchange between a high-temperature gas and a liquid having a lower temperature than the high-temperature gas to heat the liquid are incorporated and used in various pieces of equipment. For example, water heaters are widely used to burn fuel gas to generate hot water. Such a water heater burns fuel gas to produce high-temperature combustion exhaust gas and causes an internal heat exchanger to generate hot water through heat exchange between the combustion exhaust gas and water.

The heat exchanger includes a frame defining a part of the gas passage through which a high-temperature gas flows, multiple heat transfer plates (typically referred to as heat exchanger fins) arranged at regular intervals within the frame, and a hollow pipe extending through the multiple heat exchanger fins. The hollow pipe extends through the heat exchanger fins, and is bent in a U-shape to extend again through the heat exchanger fins in the opposite direction. This is repeated to allow the pipe to repeatedly extend through the multiple heat exchanger fins. The hollow pipe and the heat exchanger fins are formed from copper or other metal with high thermal conductivity. The hollow pipe extending through each heat exchanger fin is joined to each fin by, for example, brazing.

In the heat exchanger with this structure, a low-temperature liquid (e.g., water) is fed through one end of the hollow pipe while a high-temperature gas (e.g., combustion exhaust gas) is being fed to the gas passage, and thus the high-temperature gas flowing through the spaces between the multiple heat exchanger fins exchanges heat with the liquid flowing through the hollow pipe. The liquid heated through the heat exchange (e.g., hot water) flows out through the other end of the hollow pipe. The high-temperature gas is cooled through the heat exchange during the passage through the spaces between the multiple heat exchanger fins.

Although the heat exchanger fins in the heat exchanger come in contact with the high-temperature gas and become hot, the hollow pipe is cooled by the liquid flowing through it and remains at a lower temperature than the heat exchanger fins. In this state, the hollow pipe with the lower temperature restricts the hot heat exchanger fins that tend to expand, causing large thermal stress on the heat exchanger fins. The heat exchanger used under such a thermally heavy load for a long time may cause cracking in the heat exchanger fins due to repeated applications of thermal stress. In particular, upstream parts of the heat exchanger fins receiving a high-temperature gas flow reach a higher temperature and are likely to crack under large thermal stress.

A technique has been developed for cutting slits in the heat exchanger fins from the upstream edges receiving high-temperature gas into the heat exchanger fins to positions between adjacent hollow pipes (Patent Literature 1). Although heat exchanger fins reach a higher temperature, the slits cut in the heat exchanger fins with this technique absorb the thermal expansion of the heat exchanger fins, reducing thermal stress and preventing cracking.

CITATION LIST

Patent Literature

Patent Literature 1: Japanese Unexamined Patent Application Publication No. 11-108456

SUMMARY OF INVENTION

However, with the above technique, the heat exchanger fins have slits between all adjacent hollow pipes and thus have smaller surface areas. This lowers the performance of the heat exchanger (heat-exchange efficiency).

In response to the above issue, one or more aspects of the present invention are directed to a heat exchanger that prevents cracking in heat exchanger fins due to thermal stress while avoiding lowering heat-exchange efficiency.

In response to the above issue, a heat exchanger according to an aspect of the present invention has the structure below. The heat exchanger causes heat exchange between a high-temperature gas and a liquid having a lower temperature than the high-temperature gas to heat the liquid. The heat exchanger includes a frame defining a part of a gas passage for the high-temperature gas, a plurality of heat transfer plates arranged within the frame with a space left between the plurality of heat transfer plates for the high-temperature gas to flow, and a hollow pipe extending through the plurality of heat transfer plates. The hollow pipe receives the liquid to exchange heat with the high-temperature gas flowing through the space between the plurality of heat transfer plates. The hollow pipe extends through the plurality of heat transfer plates at predetermined N positions aligned in a direction crossing a direction in which the high-temperature gas flows through the space between the plurality of heat transfer plates, where N is an integer of at least three. The plurality of heat transfer plates each include N−1 inter-pipe portions between adjacent parts of the hollow pipe extending through the plurality of heat transfer plates at the N positions, and the N−1 inter-pipe portions of each heat transfer plate include a selected inter-pipe portion including a thermal expansion absorber between an edge of the heat transfer plate receiving inflow of the high-temperature gas and the selected inter-pipe portion to absorb thermal expansion of the heat transfer plate.

In the heat exchanger according to the aspect of the present invention, the plurality of heat transfer plates are arranged within the frame with the space left between the heat transfer plates. When the high-temperature gas flows through the space, the high-temperature gas exchanges heat with the liquid in the hollow pipe. During the heat exchange, the heat transfer plates heated by the high-temperature gas tend to expand. The heat transfer plates, through which multiple parts of the hollow pipe extend, are elongated in the direction in which the parts of the hollow pipe are aligned, and can thus have large thermal expansion accumulating in the elongation direction. When the large thermal expansion is restricted by the hollow pipe, the heat transfer plates can have large thermal stress and can crack. However, the heat transfer plates in the heat exchanger according to the aspect of the present invention each include the thermal expansion absorber between the edge of the heat transfer plate receiving the inflow of the high-temperature gas and the selected inter-pipe portion to absorb thermal expansion of the heat transfer plate. In this structure, the thermal expansion absorber absorbs thermal expansion before accumulating, reducing thermal stress on the heat transfer plate and reducing cracking. Although each heat transfer plate receiving N parts of the hollow pipe includes N−1 inter-pipe portions, a selected one or more of the N−1 inter-pipe portions, rather than all of the N−1 inter-pipe portions, may include the thermal expansion absorber to prevent large thermal expansion from accumulating, thus reducing thermal stress on the heat transfer plate and reducing cracking. Such selected one or more of the N−1 inter-pipe portions including the thermal expansion absorber can also avoid lowering the heat-exchange efficiency as compared with the structure with all the inter-pipe portions including thermal expansion absorbers.

In the heat exchanger according to the above aspect of the present invention, the thermal expansion absorber may be a cut extending from the edge of the heat transfer plate receiving the inflow of the high-temperature gas to the selected inter-pipe portion.

This thermal expansion absorber can be easily formed at multiple positions of the heat transfer plates.

In the heat exchanger according to the above aspect of the present invention, the inter-pipe portions positioned described below may be selected, from the inter-pipe portions at the multiple (N−1) positions of each heat transfer plate, as selected inter-pipe portions each including the thermal expansion absorber. As described above, the N parts of the hollow pipe extend through the heat transfer plate, and the N−1 inter-pipe portions are formed between the N parts of the hollow pipe. Thus, selecting one or more (or K, smaller than N−1) inter-pipe portions from the N−1 inter-pipe portions may mean that the K inter-pipe portions (selected inter-pipe portions) are selected to divide the heat transfer plate into multiple (K+1) sub-areas through which the hollow pipe extends. When the K inter-pipe portions are selected from different positions to divide the heat transfer plate into K+1 sub-areas, each sub-area receives a different number of parts of the hollow pipe. The selected inter-pipe portions may be positioned to allow each of the sub-areas to receive not more than three parts of the hollow pipe extending through the sub-areas.

For example, with three parts of the hollow pipe extending through each sub-area, thermal expansion of the heat transfer plate surrounding the central hollow pipe part pushes the right hollow pipe part rightward and the left hollow pipe part leftward. Then, the heat transfer plate surrounding the left hollow pipe part pushed leftward and the right hollow pipe part pushed rightward expands thermally, causing the leftward and rightward thermal expansion to accumulate. However, the accumulating thermal expansion is absorbed by the thermal expansion absorber formed on the left of the left hollow pipe part and the thermal expansion absorber formed on the right of the right hollow pipe part, causing substantially no accumulation of thermal expansion. Thus, with the inter-pipe portions selected from positions that allow not more than three parts of the hollow pipe to extend through each sub-area, the sub-area avoids accumulation of thermal expansion and also prevents cracking.

In the heat exchanger according to the above aspect of the present invention, the inter-pipe portions positioned described below may be selected from multiple inter-pipe portions as selected inter-pipe portions. More specifically, the selected inter-pipe portions may be positioned to allow the sub-areas to receive the same number of parts of the hollow pipe or numbers of parts of the hollow pipe different from one another by not more than one.

When the heat transfer plate is heated, thermal expansion of each sub-area accumulates in the elongation direction. However, the selected inter-pipe portions each including the thermal expansion absorber do not accumulate thermal expansion across the selected inter-pipe portions. The thermal expansion accumulates within each sub-area, greater in a long sub-area (receiving more parts of the hollow pipe) than in a short sub-area (receiving fewer parts of the hollow pipe). Thus, for a heat transfer plate having a long sub-area and a short sub-area, the long sub-area is likely to crack. However, with the selected inter-pipe portions positioned to allow multiple sub-areas to receive the same number of parts of the hollow pipe or numbers of parts of the hollow pipe different from one another by not more than one, each sub-area is not more likely to crack than the other sub-areas, thus reducing cracking in the heat transfer plates.

In the heat exchanger according to the above aspect of the present invention, the selected inter-pipe portion may be at least one of inter-pipe portions symmetric to each other among the N−1 inter-pipe portions.

This structure prevents the heat transfer plates from having thermal stress biased in the elongation direction, and thus avoids warping of the heat transfer plates.

In the heat exchanger according to the above aspect of the present invention, each heat transfer plate may receive the hollow pipe extending through the heat transfer plate at the N positions, and receive a plurality of parts of the hollow pipe extending through the heat transfer plate at positions downstream in a direction in which the high-temperature gas flows. In this structure, the selected inter-pipe portion may be selected from the N−1 inter-pipe portions between upstream parts of the hollow pipe extending through the heat transfer plate at the N positions.

The high-temperature gas is cooled through heat exchange during the passage through the space between the heat transfer plates. As the high-temperature gas has a lower temperature downstream, the heat transfer plates also have a lower temperature downstream than upstream. With multiple upstream and downstream parts of the hollow pipe extending through the heat transfer plates in the high-temperature gas flow, inter-pipe portions each including the thermal expansion absorber may be selected from inter-pipe portions between the upstream parts of the hollow pipe to prevent cracking in the heat transfer plates.

DETAILED DESCRIPTION

Figure 1:
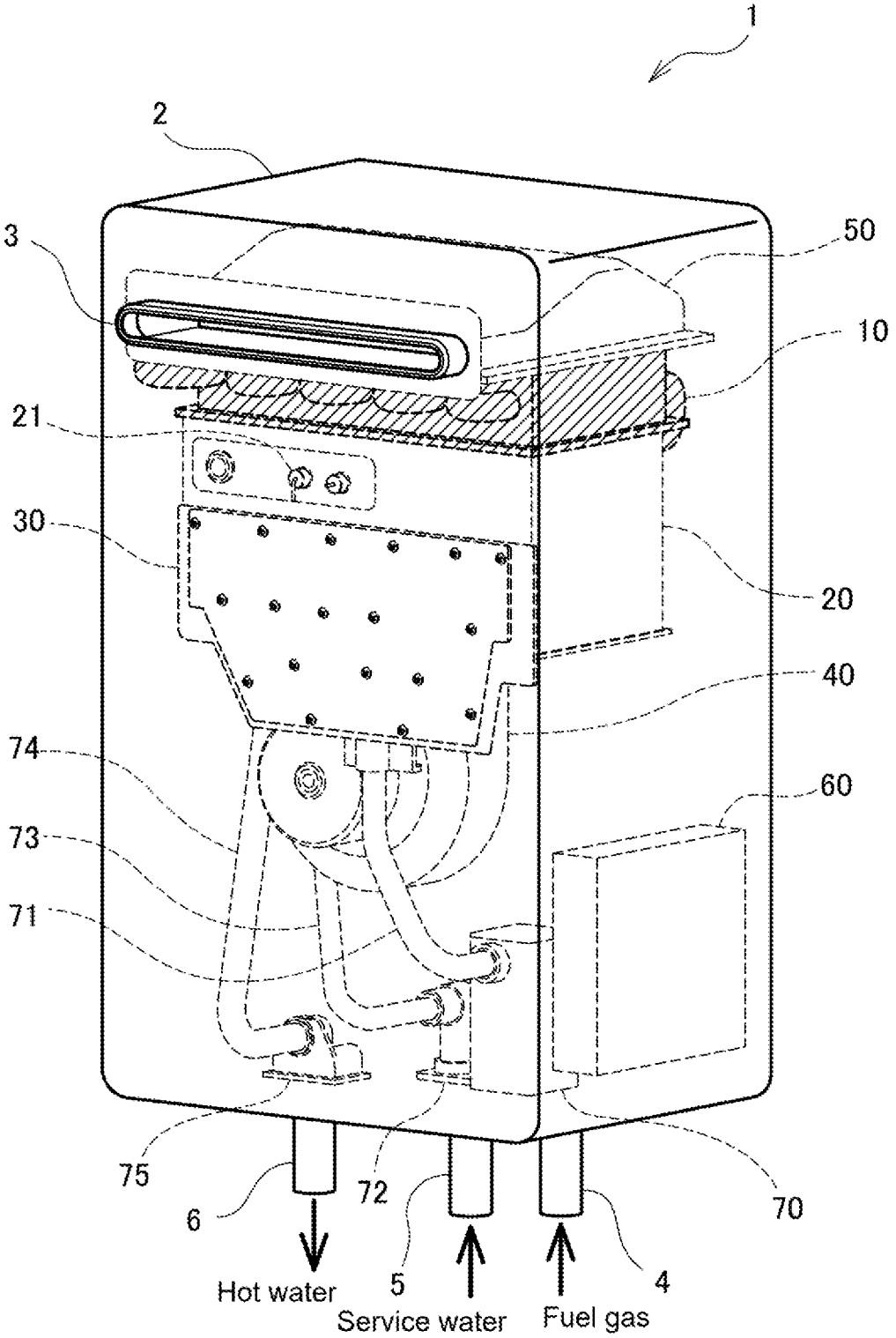
FIG. 1 is a schematic diagram of a water heater 1 including a heat exchanger 10 according to an embodiment.

FIG. 1 is a schematic diagram of a water heater 1 including a heat exchanger 10 according to an embodiment. As shown in the figure, the water heater 1 includes a substantially rectangular body case 2 with an exhaust port 3 protruding from a side surface. The body case 2 has, on its bottom surface, a gas channel 4 for feeding fuel gas to the water heater 1, a service water channel 5 for feeding service water to the water heater 1, and a hot water channel 6 for discharging hot water generated in the water heater 1. The channels protrude from the bottom surface of the body case 2.

In addition to the heat exchanger 10 according to the present embodiment, the water heater 1 also includes a combustion compartment 20, a gas manifold 30, a blower fan 40, a top cover 50, a controller 60, and a main valve unit 70 in the body case 2. The combustion compartment 20 is a hollow, prism component that is rectangular in horizontal cross section and is open at its top and bottom. The combustion compartment 20 has a lower space accommodating gas burners (not shown) that burn fuel gas. The combustion compartment 20 has an upper space without the gas burners, which is used as a combustion chamber by the gas burners for burning fuel gas.

The combustion compartment 20 includes the gas manifold 30 fixed on its side surface (front surface in FIG. 1) for feeding fuel gas to the gas burners (not shown) in the combustion compartment 20, and also includes a spark plug 21 above the gas manifold 30. The combustion compartment 20 further includes the blower fan 40 fixed on its lower end for feeding combustion air to the gas burners. The combustion air is fed from the blower fan 40. While the spark plug 21 is sparking, the fuel gas is fed from the gas manifold 30 to the gas burners in the combustion compartment 20. The fed fuel gas is then burned in the combustion chamber inside the combustion compartment 20 to produce hot combustion exhaust gas. The gas channel 4 for receiving fuel gas from outside is connected to the main valve unit 70 fixed on the inner bottom surface of the body case 2. The fuel gas is fed from the main valve unit 70 to the gas manifold 30 through a fuel gas tube 71.

The combustion compartment 20 includes the heat exchanger 10 according to the present embodiment fixed on its upper end. In FIG. 1, the heat exchanger 10 is hatched. Although its structure will be described later, the heat exchanger 10 allows combustion exhaust gas produced in the combustion compartment 20 to flow inside. The combustion exhaust gas flowing inside the heat exchanger 10 exchanges heat with service water to generate hot water. The heat exchanger 10 receives service water through a service water tube 73 having an upstream end connected to a connector 72 fixed on the inner bottom surface of the body case 2. The connector 72 is connected to the service water channel 5 for feeding service water to the water heater 1. The service water fed through the service water channel 5 thus flows through the connector 72 and the service water tube 73 to the heat exchanger 10. The hot water generated in the heat exchanger 10 flows out through a hot water tube 74 having a downstream end connected to a connector 75 fixed on the inner bottom surface of the body case 2. The connector 75 is connected to the hot water channel 6. The hot water generated in the heat exchanger 10 thus flows through the hot water tube 74 and the connector 75 out of the water heater 1 through the hot water channel 6.

The heat exchanger 10 includes the top cover 50 fixed on its top. The top cover 50 is formed from a pressed metal plate. The combustion exhaust gas produced in the combustion compartment 20 flows through the heat exchanger 10 and is then guided by the top cover 50 to the exhaust port 3. The combustion exhaust gas in the present embodiment corresponds to high-temperature gas in one or more aspects of the present invention. The combustion exhaust gas flows through the combustion compartment 20 and the heat exchanger 10 before flowing out from the exhaust port 3 through the top cover 50. Thus, the internal spaces of the combustion compartment 20 and the heat exchanger 10 correspond to a gas passage in one or more aspects of the present invention.

Figure 2A:
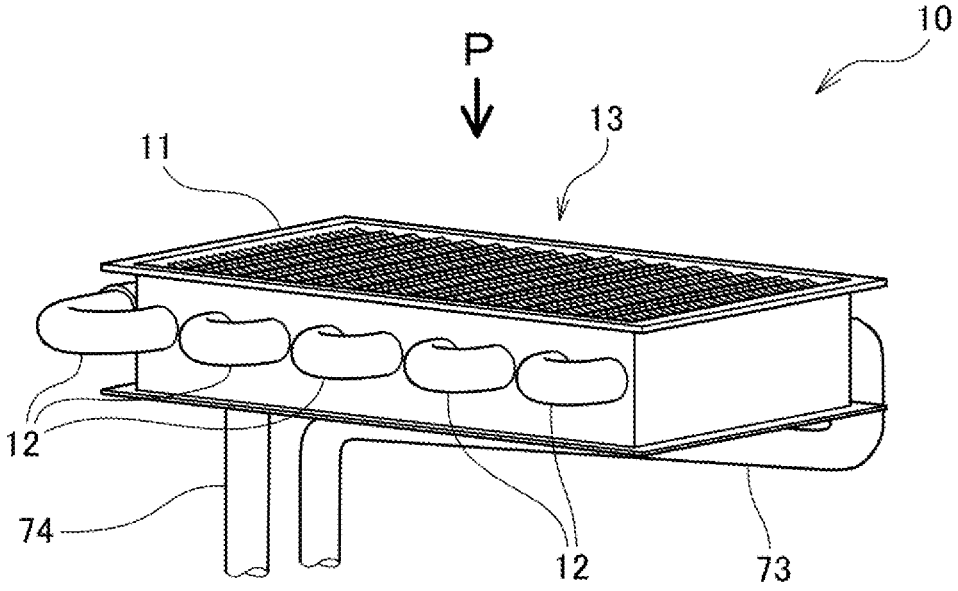
FIGS. 2A and 2B are schematic views of the heat exchanger 10 according to the embodiment.
Figure 2B:
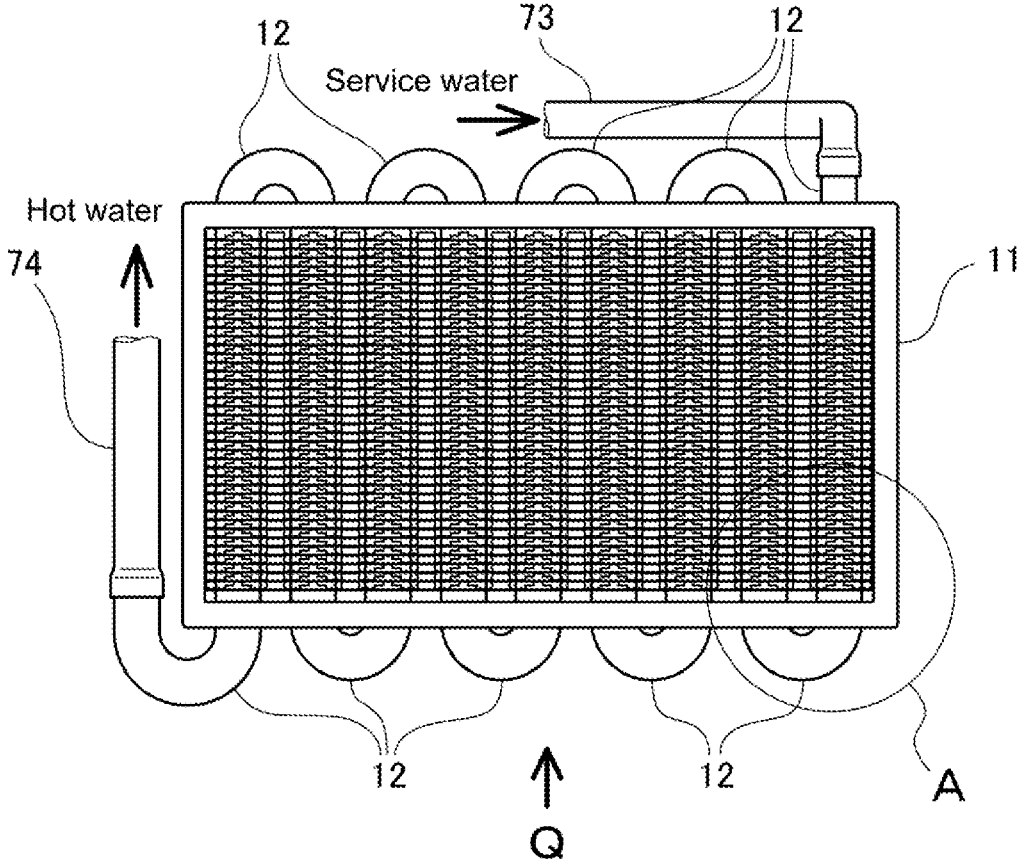

FIGS. 2A and 2B are schematic views of the heat exchanger 10 according to the present embodiment. FIG. 2A shows the appearance of the heat exchanger 10. FIG. 2B shows the heat exchanger 10 as viewed from above in the direction indicated by arrow P in FIG. 2A. As shown in FIGS. 2A and 2B, the heat exchanger 10 includes a rectangular frame 11, multiple heat exchanger fins 13 arranged within the frame 11, and a hollow pipe 12 extending through the frame 11 and the multiple heat exchanger fins 13. The hollow pipe 12 extends through the frame 11 and the multiple heat exchanger fins 13, and is bent in a U-shape to extend again through the frame 11 and the heat exchanger fins 13 in the opposite direction. This is repeated to form a serpentine shape. As shown in FIGS. 2A and 2B, the hollow pipe 12 extends through the frame 11 and the multiple heat exchanger fins 13 nine times. The hollow pipe 12 has an upstream end connected to the service water tube 73, and a downstream end connected to the hot water tube 74. In the present embodiment, the frame 11, the hollow pipe 12, and the heat exchanger fins 13 are all formed from copper or other metal with high thermal conductivity. The heat exchanger fins 13 in the present embodiment correspond to heat transfer plates in one or more aspects of the present invention.

Figure 3:
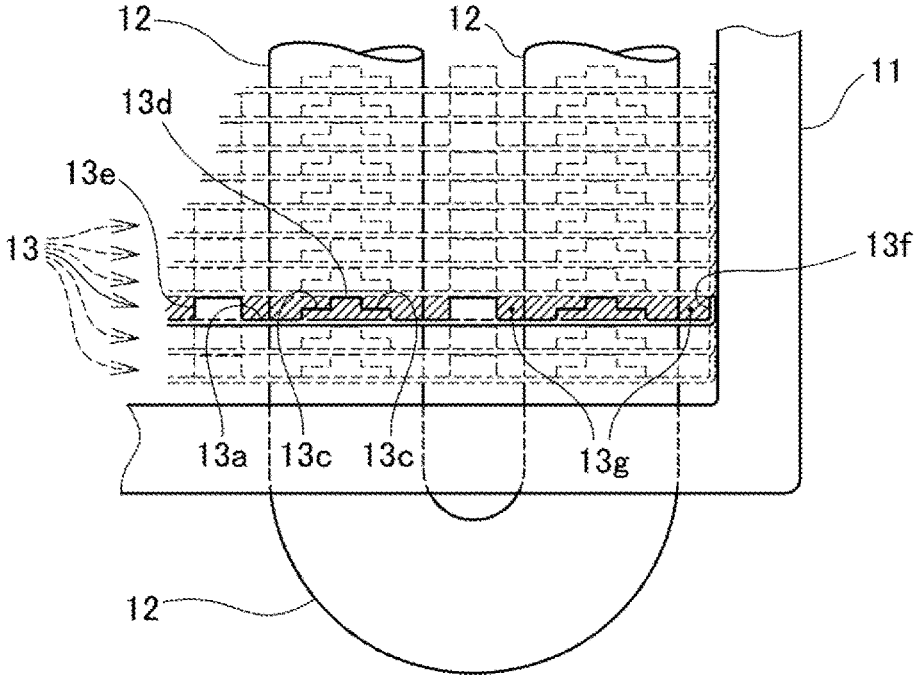
FIG. 3 is an enlarged partial view of the heat exchanger 10 showing heat exchanger fins 13 fitted on a hollow pipe 12.

FIG. 3 is an enlarged partial view of the heat exchanger 10 (the area indicated by A in FIG. 2B) showing the heat exchanger fins 13 fitted on the hollow pipe 12. As shown in the figure, the multiple heat exchanger fins 13 are arranged at regular intervals within the frame 11. For clarity of illustration, one of the heat exchanger fins 13 is indicated by a solid line and the other heat exchanger fins 13 by dashed lines in FIG. 3.

Each heat exchanger fin 13 is an elongated plate, and mainly includes flat heat transfer portions 13*a* with through-holes 13*b* (refer to FIG. 4) to receive the hollow pipe 12. As shown in FIG. 3, each through-hole 13*b* has an inner periphery end surface bent up into a joint 13*c* to which the hollow pipe 12 is brazed. The bent joint 13*c* has, on its distal end, a protruding edge 13*d* in contact with an adjacent heat exchanger fin 13 to maintain a predetermined distance from the adjacent heat exchanger fin 13. The upper end of the heat transfer portion 13*a* (facing the front of FIG. 3) is also bent up into a protruding edge 13*e* between adjacent parts of the hollow pipe 12 to maintain a predetermined distance from the adjacent heat exchanger fin 13. The edge of the heat transfer portion 13*a* on each end of the heat exchanger fin 13 is also bent up into a protruding edge 13*f* to maintain a predetermined distance from the adjacent heat exchanger fin 13. Thus, the multiple heat exchanger fins 13 are arranged at regular intervals with a space 13*g* between adjacent heat exchanger fins 13. In FIG. 3, the space 13*g* between adjacent heat exchanger fins 13 is hatched.

Figure 4:
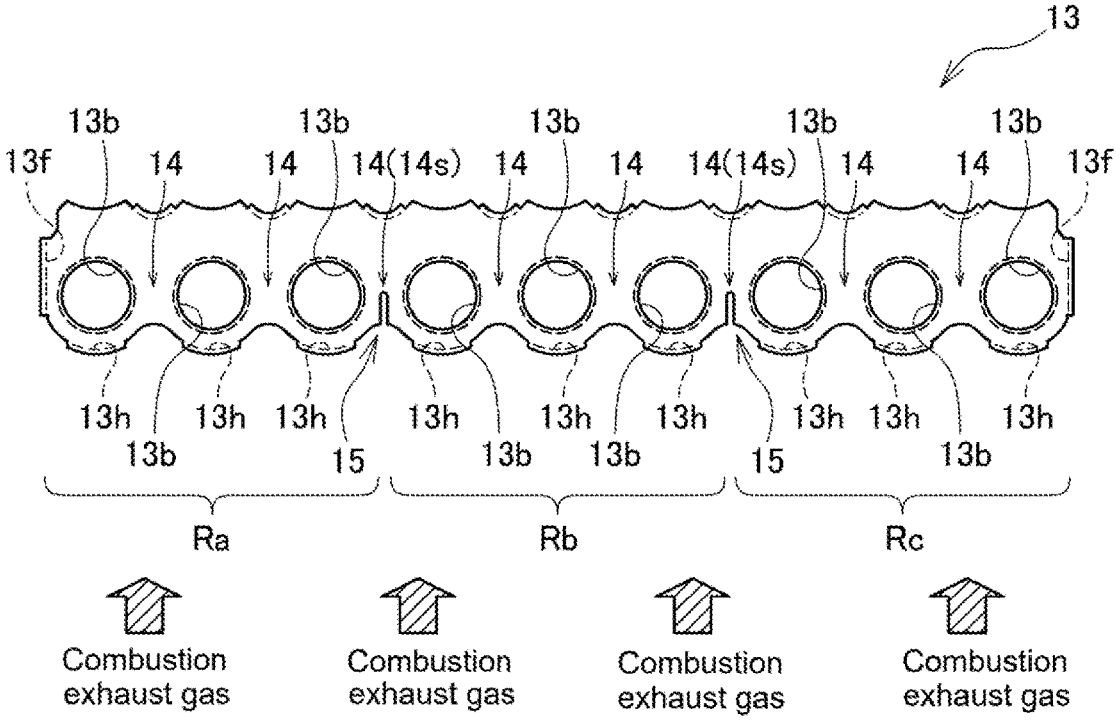
FIG. 4 is a diagram of a heat exchanger fin 13 included in the heat exchanger 10 according to the embodiment, showing the structure in detail.

FIG. 4 is a diagram of a heat exchanger fin 13 showing the structure in detail as viewed in the direction indicated by arrow Q in FIG. 2B. As shown in the figure, the heat exchanger fin 13 has, at regular intervals, the through-holes 13*b* to receive the hollow pipe 12 at multiple (nine in the figure) positions across the length of the elongated plate member. As indicated by hatched arrows in the figure, combustion exhaust gas flows in along the width of the heat exchanger fin 13. Thus, the multiple through-holes 13*b* are aligned in a direction crossing the flow direction of the combustion exhaust gas. The two ends of the heat exchanger fin 13 are bent into the protruding edges 13*f* (refer to FIG. 3). In upstream areas facing the flow direction of the combustion exhaust gas (facing downward in FIG. 4), the edge of the heat exchanger fin 13 upstream from each through-hole 13*b* is bent into a protruding edge 13*h* to leave the space 13*g* from the adjacent heat exchanger fin 13.

In the present embodiment, the heat exchanger fin 13 includes inter-pipe portions 14 between the through-holes 13*b*. As shown in FIG. 4, the upstream edge of the heat exchanger fin 13 receiving the flow of the combustion exhaust gas has the shape of a wave recessed downstream into the inter-pipe portions 14. Selected ones of the recesses on the edge include slits cut in the heat exchanger fin 13 extending from the edge of the heat exchanger fin 13 to the inter-pipe portions 14 to form thermal expansion absorbers 15. The heat exchanger fin 13 illustrated in FIG. 4 has nine through-holes 13*b* and thus includes eight inter-pipe portions 14, and the upstream edge of the heat exchanger fin 13 receiving combustion exhaust gas has eight recesses. The thermal expansion absorber 15 may be formed in one or more selected ones (but not all) of the eight recesses on the edge. Among the eight inter-pipe portions 14, the inter-pipe portions 14 including the thermal expansion absorbers 15 in the edge of the heat exchanger fin 13 are particularly referred to as selected inter-pipe portions 14*s*.

The heat exchanger fin 13 including the thermal expansion absorbers 15 in the upstream edge receiving the flow of the combustion exhaust gas can be prevented from cracking when the heat exchanger 10 is used over a long time under thermally severe conditions for the reasons below. For convenience of explanation, a heat exchanger fin 13 with no thermal expansion absorber 15 will be described first. When heated by combustion exhaust gas, the heat exchanger fin 13 reaches a higher temperature and expands. The expansion due to heat will be simply referred to as thermal expansion. The coefficient of thermal expansion of metal (in other words, thermal expansion per unit length for a unit increase in temperature) is constant in all directions. However, for the elongated heat exchanger fin 13 as shown in FIG. 4, the thermal expansion is larger in the elongation direction (horizontal direction in FIG. 4) than in the transverse direction (vertical direction in FIG. 4). The larger thermal expansion in the elongation direction is restricted by the multiple parts of the hollow pipe 12 extending through the heat exchanger fin 13, and the resultant larger thermal stress on the heat exchanger fin 13 may cause cracking. Thus, cracking in the heat exchanger fin 13 may result from the heat exchanger fin 13 thermally expanding more in the elongation direction, rather than simply from the heat exchanger fin 13 reaching a higher temperature.

Although the heat exchanger fin 13 illustrated in FIG. 4 can receive the nine parts of the hollow pipe 12, the two thermal expansion absorbers 15 formed as slits divide the hollow pipe 12 into three sub-areas Ra, Rb, and Rc each including three parts of the hollow pipe 12. The sub-areas Ra, Rb, and Rc, each of which is much shorter than the entire heat exchanger fin 13, greatly reduce thermal expansion in the elongation direction. The heat exchanger fin 13 is thus prevented from cracking. This will be described in more detail.

Figure 5:
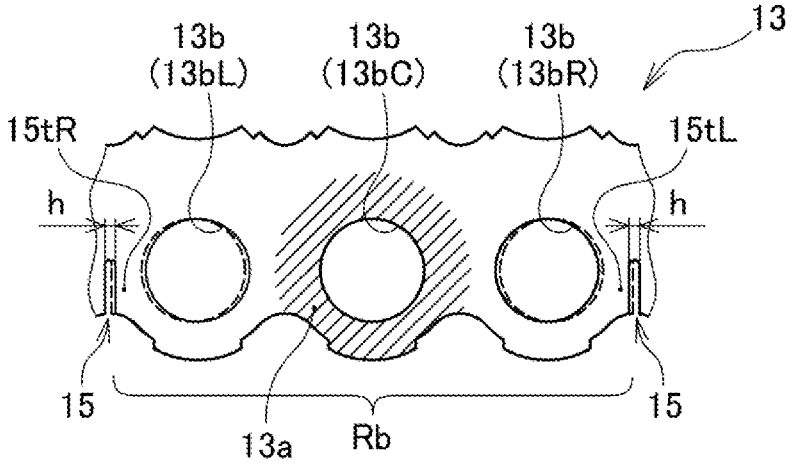
FIG. 5 is a diagram showing the mechanism for thermal expansion absorbers 15 to absorb thermal expansion of the heat exchanger fin 13.

FIG. 5 is an enlarged diagram of a sub-area Rb (refer to FIG. 4) of the heat exchanger fin 13. As shown in the figure, the sub-area Rb has three through-holes 13*b*, which are referred to as a through-hole 13*b*C for the central through-hole 13*b*, a through-hole 13*b*L for the left through-hole 13*b*, and a through-hole 13*b*R for the right through-hole 13*b* for convenience. When the heat exchanger fin 13 is heated, the heat transfer portion 13*a* surrounding the central through-hole 13*b*C (hatched in the figure) thermally expands to push the left through-hole 13*b*L to the left and the right through-hole 13*b*R to the right. In the figure, the through-holes 13*b*L and 13*b*R pushed to the left and the right are indicated by dashed lines. Moreover, the heat transfer portion 13*a* surrounding the left through-hole 13*b*L thermally expands to the right and the left from the position pushed to the left together with the through-hole 13*b*L (indicated by the dashed line), pushing the through-hole 13*b* (not shown) on the left of the left through-hole 13*b*L further to the left. In this manner, the heat exchanger fin 13 accumulates thermal expansion in the elongation direction. A longer heat exchanger fin 13 thus accumulates more thermal expansion.

However, the thermal expansion absorbers 15 in the heat exchanger fin 13 absorb the accumulating thermal expansion. More specifically, as shown in FIG. 5, the thermal expansion of the heat transfer portion 13*a* surrounding the through-hole 13*b*L pushed to the left (indicated by the dashed line in the figure) is absorbed by the thermal expansion absorber 15 formed as a slit on the left of the through-hole 13*b*L. The thermal expansion merely shifts an edge 15*t*R on the right of the slit leftward and does not reach the adjacent left through-hole 13*b* (not shown). In FIG. 5, the edge 15*t*R of the thermal expansion absorber 15 shifted leftward by the thermal expansion is indicated by a dashed line.

The same applies to the through-hole 13*b*R on the right of the central through-hole 13*b*C. More specifically, the thermal expansion of the heat transfer portion 13*a* surrounding the through-hole 13*b*R pushed to the right (indicated by the dashed line in the figure) is absorbed by the thermal expansion absorber 15 on the right of the through-hole 13*b*R. The thermal expansion merely shifts an edge 15*t*L on the left of the slit rightward and does not reach the adjacent right through-hole 13*b* (not shown). In FIG. 5, the edge 15*t*L of the thermal expansion absorber 15 shifted rightward by the thermal expansion is indicated by a dashed line.

Although the sub-area Rb at the center of the heat exchanger fin 13 (refer to FIG. 4) has been described with reference to FIG. 5, the same applies to the sub-area Ra on the left of the sub-area Rb and the sub-area Rc on the right of the sub-area Rb. Thus, when the heat exchanger fin 13 is heated to cause thermal expansion of the sub-areas Ra, Rb, and Rc, the rightward shift of the edge 15*t*L of the thermal expansion absorber 15 and the leftward shift of the edge 15*t*R of the thermal expansion absorber 15 absorb the thermal expansion to prevent accumulation of thermal expansion across the thermal expansion absorbers 15. This structure prevents the heat exchanger fin 13 from cracking.

As clearly described above, the slit of each thermal expansion absorber 15 has a width h large enough to prevent contact between the edge 15*t*L shifted rightward by thermal expansion and the edge 15*t*R shifted leftward by thermal expansion. The heat exchanger fin 13 has a part (upstream part) receiving the inflow of the combustion exhaust gas reaching higher temperatures than a downstream part. The heat exchanger fin 13 thus has a larger thermal expansion in the upstream part than in the downstream part. Thus, each heat exchanger fin 13 may include the thermal expansion absorber 15 as a cut extending from the upstream edge as illustrated in FIG. 4.

As shown in FIG. 4, the heat exchanger fin 13 includes the thermal expansion absorbers 15 at positions to divide the heat exchanger fin 13 covering the nine through-holes 13*b* into the sub-areas Ra, Rb, and Rc each covering three through-holes 13*b*. However, the thermal expansion absorbers 15 may be formed at positions that form multiple sub-areas with different lengths, and the number of thermal expansion absorbers 15 may not be two. For example, a heat exchanger fin 13 illustrated in FIG. 6 includes three thermal expansion absorbers 15. The thermal expansion absorbers 15 are formed at positions to divide the heat exchanger fin 13 into a sub-area Ra covering five through-holes 13*b*, a sub-area Rb covering one through-hole 13*b*, a sub-area Rc covering two through-holes 13*b*, and a sub-area Rd covering one through-hole 13*b*, which are arranged in this order from left to right.

Also in such a configuration shown in FIG. 4, thermal expansion of the sub-areas Ra, Rb, Rc, and Rd is absorbed by the thermal expansion absorbers 15 without accumulating largely, for the same reasons as described above with reference to FIG. 5. The sub-area Ra, covering five through-holes 13*b*, accumulates thermal expansion. However, the sub-area Ra is shorter than the entire heat exchanger fin 13 and thus accumulates less thermal expansion. Thus, this structure generates less thermal stress when the hollow pipe 12 extending through the through-holes 13*b* restricts the thermal expansion than the structure including no thermal expansion absorber 15, and thus reduces cracking.

Figure 6:
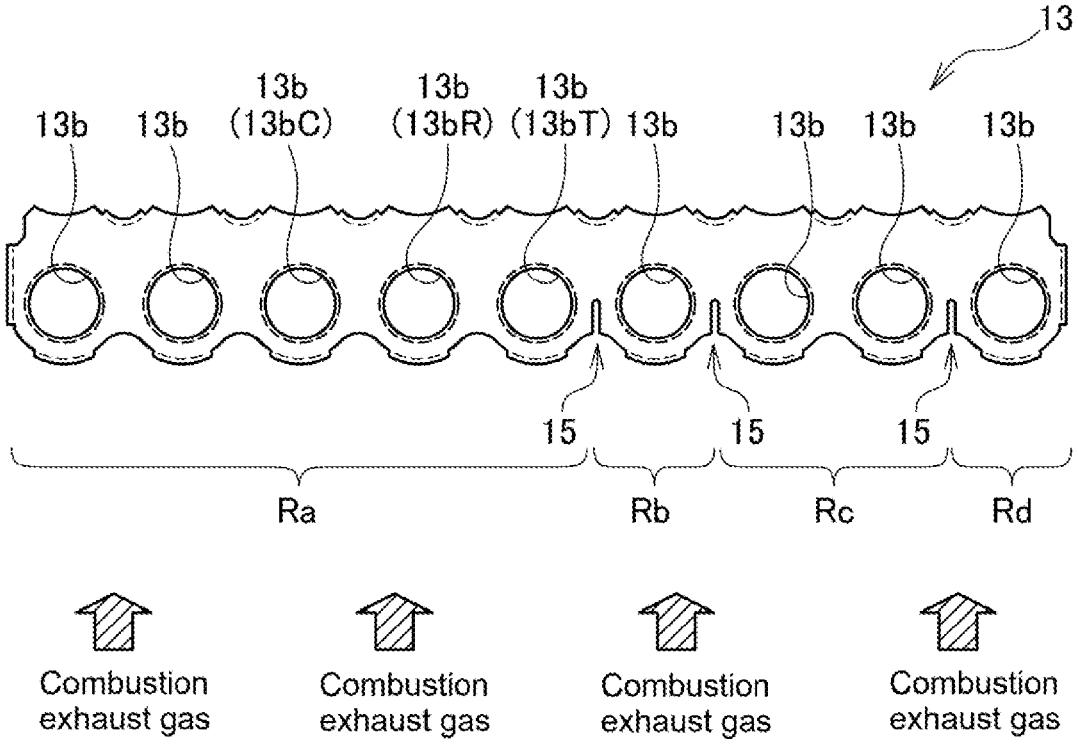
FIG. 6 is a diagram of a heat exchanger fin 13 including thermal expansion absorbers 15 according to another embodiment.

As illustrated in FIG. 6, with a short sub-area (having fewer through-holes 13*b*) and a long sub-area (having more through-holes 13*b*), the accumulating thermal expansion is larger in the long sub-area than in the short sub-area. Thus, as illustrated in FIG. 4, the thermal expansion absorbers 15 are positioned in the heat exchanger fin 13 to allow multiple sub-areas to have the same length (have the same number of through-holes 13*b*) or to have numbers of through-holes 13*b* different from one another by not more than one.

Although more thermal expansion absorbers 15 formed in the heat exchanger fin 13 allow a sub-area to be shorter (have fewer through-holes 13*b*), the surface area of the heat transfer portions 13*a* in the heat exchanger fin 13 may decrease and lower the efficiency of heat exchange. However, to prevent thermal expansion of sub-areas from accumulating, a sub-area having one through-hole 13*b* (e.g., sub-areas Rb and Rd in FIG. 6) is not largely different from a sub-area having three through-holes 13*b* (e.g., sub-areas Ra, Rb, and Rc in FIG. 4). This is because a sub-area having three through-holes 13*b* actually receives no accumulation of thermal expansion as described above with reference to FIG. 5. Thermal expansion of the heat transfer portion 13*a* surrounding the central through-hole 13*b*C may reach the left and right through-hole 13*b*L and 13*b*R. In addition to the thermal expansion, thermal expansion of the heat transfer portions 13*a* around the left and right through-holes 13*b*L and 13*b*R may be added, thus accumulating the thermal expansion. However, the thermal expansion is absorbed by the thermal expansion absorbers 15 adjacent to the left and right through-holes 13*b*L and 13*b*R.

Thus, for a heat exchanger fin 13 having the number of through-holes 13*b* that is a multiple of three, as illustrated in FIG. 4, thermal expansion absorbers 15 may be positioned to cause each sub-area to have three through-holes 13*b*. For the number of through-holes 13*b* that is not a multiple of three, thermal expansion absorbers 15 may be positioned to cause some sub-areas to have three through-holes 13*b*, and the other sub-areas to have two or four through-holes 13*b*. This structure minimizes the number of thermal expansion absorbers 15 formed in the heat exchanger fin 13, enabling each sub-area to avoid accumulation of thermal expansion. This heat exchanger thus prevents the heat exchanger fin 13 from cracking and avoids lowering the efficiency of heat exchange.

In other examples, thermal expansion absorbers 15 that form sub-areas in different lengths may be positioned to cause the sub-areas to be symmetrical with respect to the inflow of the combustion exhaust gas into the heat exchanger fin 13. For example, the heat exchanger fin 13 illustrated in FIG. 7 has eight through-holes 13*b*, with sub-areas Ra and Rc each having three through-holes 13*b* and a sub-area Rb having two through-holes 13*b*. In this case, the thermal expansion absorbers 15 are positioned to cause the sub-area Rb to have two through-holes 13*b* at the center, and the sub-areas Ra and Rc each to have three through-holes 13*b* on the right and the left. This structure prevents the heat exchanger fin 13 from having thermal stress biased rightward or leftward, and thus avoids warping of the heat exchanger fin 13.

Figure 7:
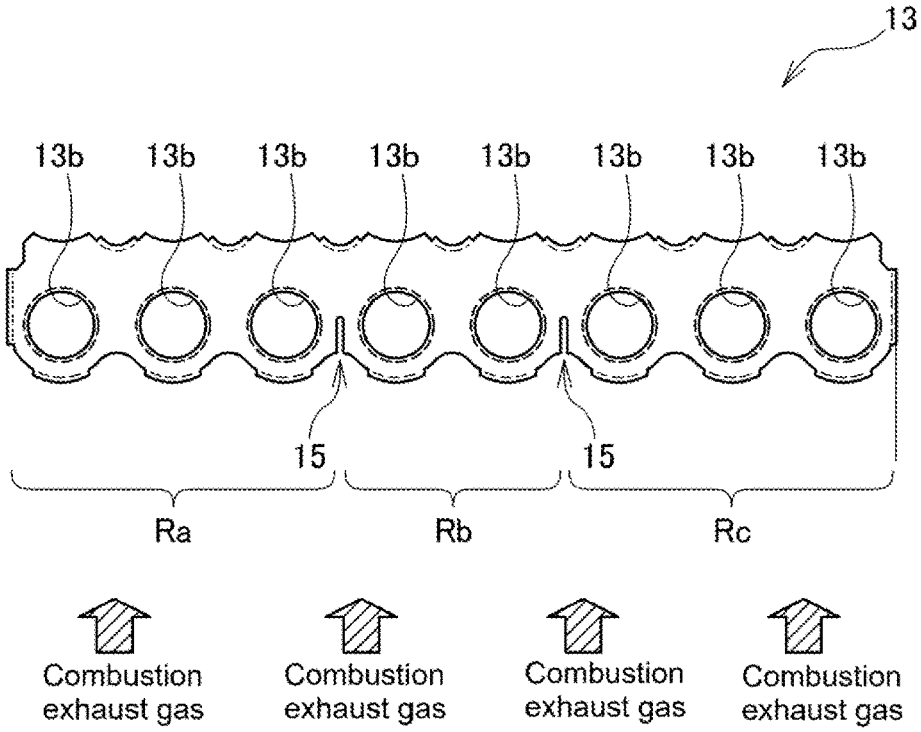
FIG. 7 is a diagram of a heat exchanger fin 13 including symmetrical thermal expansion absorbers 15.
Figure 8:
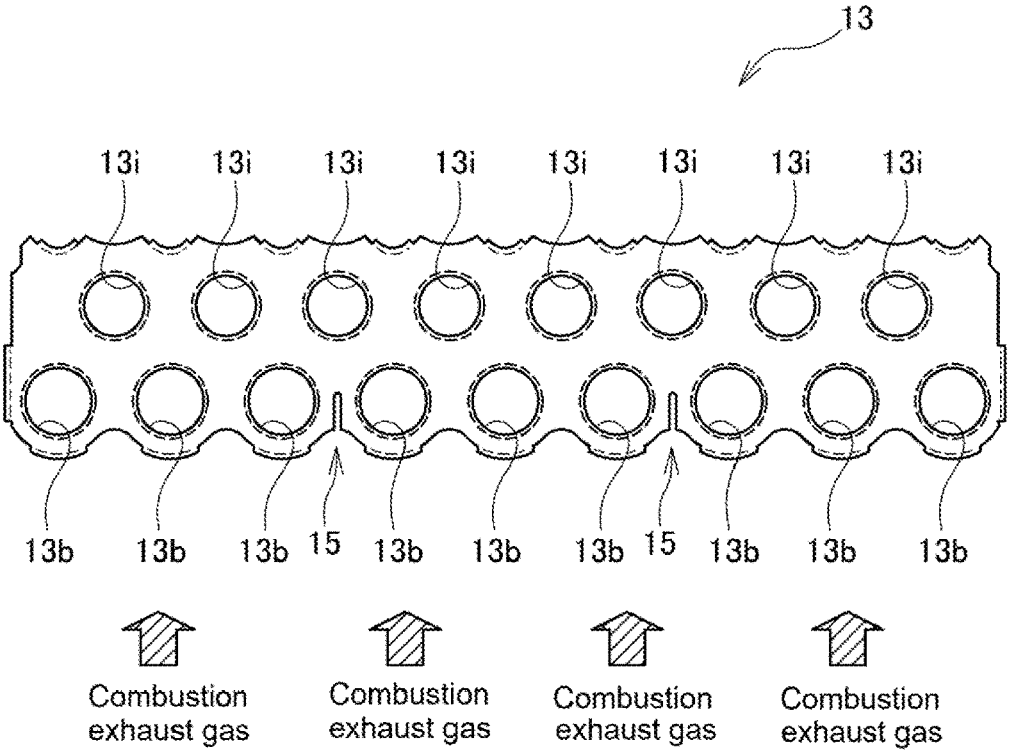
FIG. 8 is a diagram of a heat exchanger fin 13 including through-holes 13*b* in rows.

As illustrated in FIGS. 4, 6, and 7, each heat exchanger fin 13 in the above embodiment has multiple through-holes 13*b* aligned in a direction crossing the flow of the combustion exhaust gas (lateral direction). However, as illustrated in FIG. 8, a heat exchanger fin 13 may have the multiple through-holes 13*b* arranged upstream in the flow direction of the combustion exhaust gas as well as multiple through-holes 13*i* aligned downstream. The heat exchanger fin 13 has an upstream part reaching a higher temperature than a downstream part in the flow of the combustion exhaust gas. As shown in FIG. 8, for the through-holes 13*b* and 13*i* in rows in the flow of the combustion exhaust gas, thermal expansion absorbers 15 may be formed for the through-holes 13*b* that are aligned upstream.

Each thermal expansion absorber 15 in the above embodiment is planar (more specifically, a slit cut in a part of the flat heat transfer portion 13*a*). However, the thermal expansion absorber 15 may be three-dimensional (more specifically, a slit cut in a part of the flat heat transfer portion 13*a*, with the heat transfer portion 13*a* bent at either or both of its edges along the slit).

Figure 9:
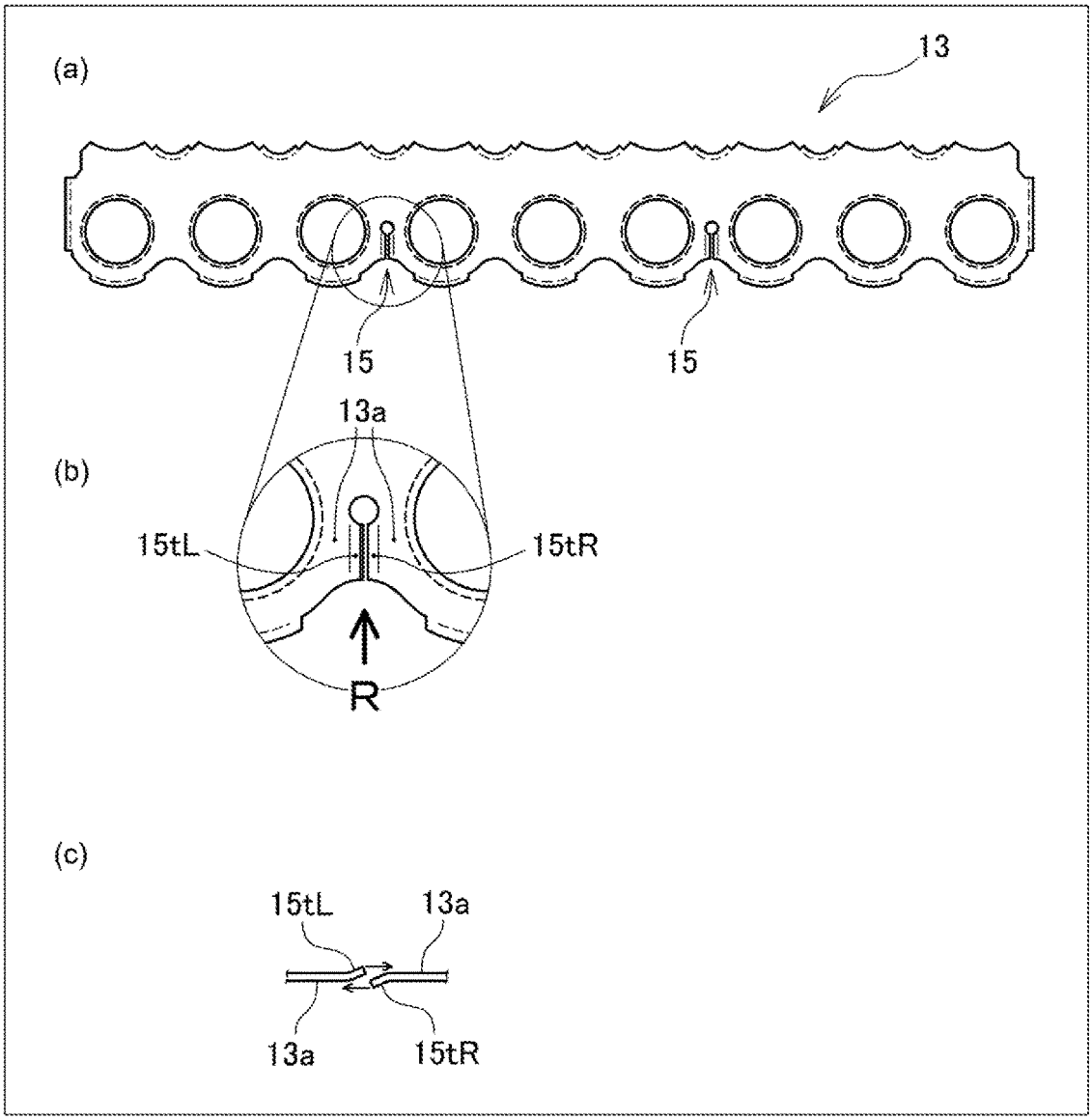
FIG. 9 illustrates schematic diagrams of thermal expansion absorbers 15 according to another embodiment.

FIG. 9 illustrates a heat exchanger fin 13 including three-dimensional thermal expansion absorbers 15. FIG. 9(*c*) shows the entire heat exchanger fin 13. FIG. 9(*b*) is an enlarged view of a thermal expansion absorber 15. FIG. 9(*c*) shows the thermal expansion absorber 15 as viewed in the direction indicated by arrow R in FIG. 9(*b*). The thermal expansion absorber 15 illustrated in FIG. 9 is formed by cutting a slit in a heat transfer portion 13*a* of the heat exchanger fin 13 (refer to FIG. 9(*b*)), bending the heat transfer portion 13*a* on the left of the cut toward the facing side of FIG. 9(*b*), and bending the heat transfer portion 13*a* on the right of the cut toward the opposite side of FIG. 9(*b*).

In this manner, an edge 15*t*L on the left and an edge 15*t*R on the right of the slit forming the thermal expansion absorber 15 are positioned on different planes (refer to FIG.

9(*c*)). When the left edge 15*t*L of the thermal expansion absorber 15 largely moves rightward, and the right edge 15*t*R largely moves leftward to absorb thermal expansion as indicated by arrows in FIG. 9(*c*), the left edge 15*t*L and the right edge 15*t*R do not come in contact with each other. The thermal expansion absorber 15 may thus have a smaller slit width h (refer to FIG. 5). The thermal expansion absorber 15 with the small width thus is less likely to reduce the surface area of the heat exchanger fin 13 or is less likely to lower the heat-exchange efficiency.

The thermal expansion absorber 15 illustrated in FIG. 9 is formed by bending the heat transfer portions 13*a* on the right and the left of the slit cut from the edge of the heat exchanger fin 13. However, the edge 15*t*L on the left and the edge 15*t*R on the right of the thermal expansion absorber 15 may be positioned on different planes, and both the heat transfer portions 13*a* on the right and the left of the slit may not be bent. Thus, the heat transfer portion 13*a* on one edge of the slit may be bent, and the heat transfer portion 13*a* on the other edge may not be bent.

Figure 10:
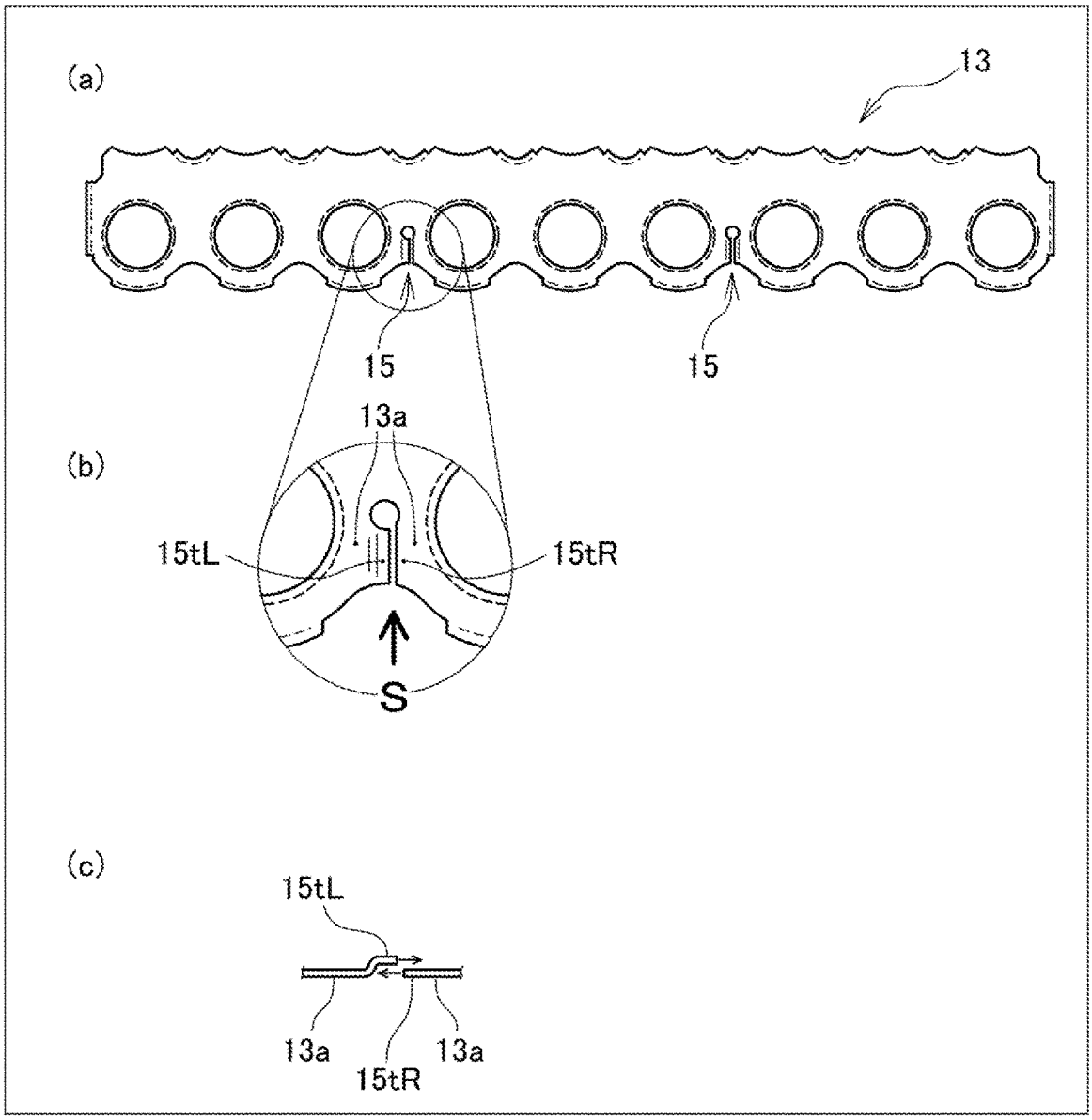
FIG. 10 illustrates schematic diagrams of thermal expansion absorbers 15 according to another embodiment.

FIG. 10 illustrates a heat exchanger fin 13 including three-dimensional thermal expansion absorbers 15 according to another modification. FIG. 10(*a*) shows the entire heat exchanger fin 13. FIG. 10(*b*) is an enlarged view of a thermal expansion absorber 15. FIG. 10(*c*) shows the thermal expansion absorber 15 as viewed in the direction indicated by arrow S in FIG. 10(*b*). The thermal expansion absorber 15 illustrated in FIG. 10 has an edge 15*t*L, which is parallel to its unbent surface, formed by cutting a slit in a heat transfer portion 13*a* of the heat exchanger fin 13 (refer to FIG. 10(*b*)) and bending the heat transfer portion 13*a* on the left of the cut. The edge 15*t*L on the left and an edge 15*t*R on the right of the slit forming the thermal expansion absorber 15 are positioned on different planes (refer to FIG. 10(*c*)). When the left and right edges 15*t*L and 15*t*R of the thermal expansion absorber 15 largely move to absorb thermal expansion as indicated by arrows in FIG. 10(*c*), the left and right edges 15*t*L and 15*t*R do not come in contact with each other. The thermal expansion absorber 15 may thus have a smaller slit width h (refer to FIG. 5), and the thermal expansion absorber 15 with the small width is less likely to reduce the surface area of the heat exchanger fin 13 or is less likely to lower the heat-exchange efficiency.

In the above embodiment, the thermal expansion absorbers 15 are formed by cutting slits in the heat exchanger fin 13. However, the thermal expansion absorbers 15 may have any shape that deforms easily to absorb thermal expansion and may not be slits in the heat exchanger fin 13.

Figure 11:
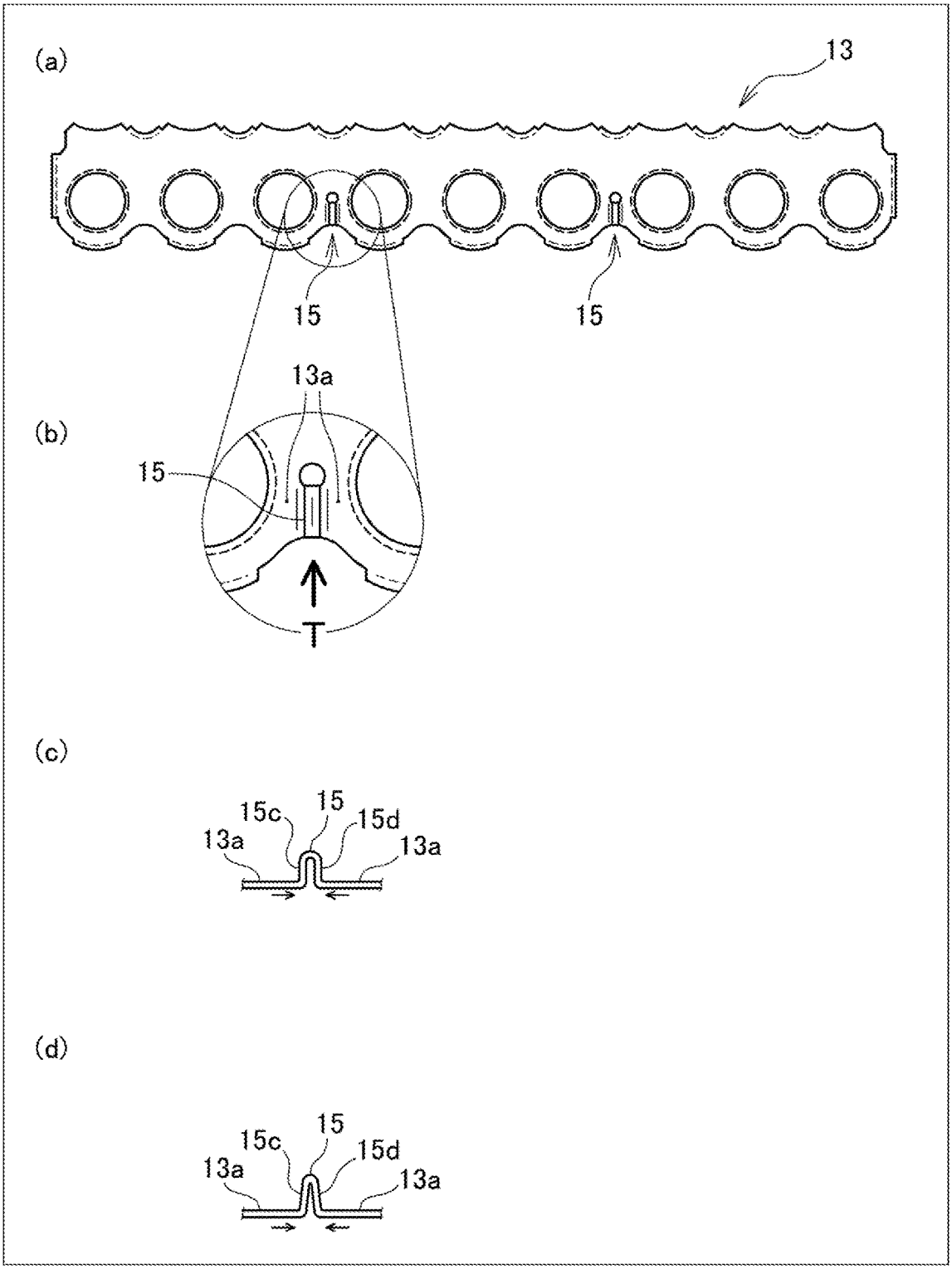
FIG. 11 illustrates schematic diagrams of slit-free thermal expansion absorbers 15 according to another embodiment.

FIG. 11 illustrates a heat exchanger fin 13 including slit-free thermal expansion absorbers 15. FIG. 11(*a*) shows the entire heat exchanger fin 13. FIG. 11(*b*) is an enlarged view of a thermal expansion absorber 15. FIG. 11(*c*) shows the thermal expansion absorber 15 as viewed in the direction indicated by arrow Tin FIG. 11(*b*). The thermal expansion absorber 15 in this shape also absorbs thermal expansion. When the heat transfer portion 13*a* on the left of the thermal expansion absorber 15 moves rightward and the heat transfer portion 13*a* on the right moves leftward due to thermal expansion of the heat exchanger fin 13 as indicated by arrows in FIG. 11(*c*), a left side wall 15*c* and a right side wall 15*d* forming a rib of the thermal expansion absorber 15 bend to absorb thermal expansion. This structure prevents the heat exchanger fin 13 from cracking.

As shown in FIG. 11(*c*), the left side wall 15*c* and the right side wall 15*d* forming the rib of the thermal expansion absorber 15 are parallel and connected to each other with an arched ceiling. However, as illustrated in FIG. 11(*d*), the right and the left side walls 15*c* and 15*d* may be placed closer to form a rib with a ridge-shaped cross section. The thermal expansion absorber 15 formed in this manner also prevents the heat exchanger fin 13 from cracking. When the heat transfer portions 13*a* come closer from the right and the left of the thermal expansion absorber 15 as indicated by arrows in FIG. 11(*d*), the right and the left side walls 15*c* and 15*d* forming the rib of the thermal expansion absorber 15 bend to absorb thermal expansion, thus preventing the heat exchanger fin 13 from cracking. As shown in FIG. 11, the slit-free thermal expansion absorber 15 does not reduce the surface area of the heat exchanger fin 13, and the heat-exchange efficiency may not be lowered.

Although the heat exchanger 10 according to the present embodiment has been described, the embodiment disclosed herein should not be construed to be restrictive, but may be modified variously without departing from the scope and the spirit of the invention.

REFERENCE SIGNS LIST

1 water heater
2 body case
3 exhaust port
4 gas channel
5 service water channel
6 hot water channel
10 heat exchanger
11 frame
12 hollow pipe
13 heat exchanger fin
13*a* heat transfer portion
13*b* through-hole
13*c* joint
13*d* protruding edge
13*e*, 13*f* protruding edge
13*g* space
13*h* protruding edge
13*i* through-hole
14 inter-pipe portion
14*s* selected inter-pipe portion
15 thermal expansion absorber
15*c*, 15*d* side wall
15*t*L, 15*t*R edge
20 combustion compartment
21 spark plug
30 gas manifold
40 blower fan
50 top cover
60 controller
70 main valve unit
71 fuel gas tube
72 connector
73 service water tube
74 hot water tube
75 connector
Ra to Rd sub-area

The invention claimed is:

1. A heat exchanger for causing heat exchange between a high-temperature gas and a liquid having a lower temperature than the high-temperature gas to heat the liquid, the heat exchanger comprising:

a frame defining a part of a gas passage for the high-temperature gas;

a plurality of heat transfer plates arranged within the frame with a space left between the plurality of heat transfer plates for the high-temperature gas to flow; and a hollow pipe extending through the plurality of heat transfer plates, the hollow pipe being configured to receive the liquid to exchange heat with the high-temperature gas flowing through the space between the plurality of heat transfer plates, wherein the hollow pipe extends through the plurality of heat transfer plates at predetermined N positions aligned in a direction crossing a direction in which the high-temperature gas flows through the space between the plurality of heat transfer plates, where N is an integer of at least three, the plurality of heat transfer plates each include N−1 inter-pipe portions between adjacent parts of the hollow pipe extending through the plurality of heat transfer plates at the N positions, the N−1 inter-pipe portions of each heat transfer plate include selected M inter-pipe portion(s) each of which includes a thermal expansion absorbing space configured between an edge of the heat transfer plate receiving inflow of the high-temperature gas and the selected inter-pipe portion(s) to absorb thermal expansion of the heat transfer plate, where M is an integer smaller than N−1, and no thermal expansion absorbing space is configured in each of non-selected N−1-M inter pipe portion(s) among the N−1 inter-pipe portions of each heat transfer plate.

2. The heat exchanger according to claim 1, wherein the thermal expansion absorbing space is a cut extending from the edge of the heat transfer plate receiving the inflow of the high-temperature gas to the selected inter-pipe portion.

3. The heat exchanger according to claim 1, wherein each heat transfer plate is divided by the selected inter-pipe portion into a plurality of sub-areas through which the hollow pipe extends, and the selected inter-pipe portion is positioned to allow each of the plurality of sub-areas to receive not more than three parts of the hollow pipe extending through the sub-areas.

4. The heat exchanger according to claim 1, wherein each heat transfer plate is divided by the selected inter-pipe portion into a plurality of sub-areas through which the hollow pipe extends, and the selected inter-pipe portion is positioned to allow the plurality of sub-areas to receive the same number of parts of the hollow pipe extending through the sub-areas or numbers of parts of the hollow pipe different from one another by not more than one.

5. The heat exchanger according to claim 1, wherein the selected inter-pipe portion is at least one of inter-pipe portions symmetric to each other among the N−1 inter-pipe portions.

6. The heat exchanger according to claim 1, wherein each heat transfer plate receives the hollow pipe extending through the heat transfer plate at the N positions, and receives a plurality of parts of the hollow pipe extending through the heat transfer plate at positions downstream in a direction in which the high-temperature gas flows, and the selected inter-pipe portion is selected from the N−1 inter-pipe portions between upstream parts of the hollow pipe extending through the heat transfer plate at the N positions.

* * * * *